US006510665B2

(12) United States Patent
Pervan

(10) Patent No.: US 6,510,665 B2
(45) Date of Patent: Jan. 28, 2003

(54) LOCKING SYSTEM FOR MECHANICAL JOINING OF FLOORBOARDS AND METHOD FOR PRODUCTION THEREOF

(75) Inventor: Darko Pervan, Viken (SE)

(73) Assignee: Valinge Aluminum AB, Viken (SE)

( * ) Notice: Subject to any disclaimer, the term of this patent is extended or adjusted under 35 U.S.C. 154(b) by 0 days.

(21) Appl. No.: 09/954,066

(22) Filed: Sep. 18, 2001

(65) Prior Publication Data

US 2002/0007609 A1 Jan. 24, 2002

Related U.S. Application Data

(63) Continuation of application No. PCT/SE01/00125, filed on Jan. 24, 2001.

(30) Foreign Application Priority Data

Jan. 24, 2000 (SE) ..... 0000200

(51) Int. Cl.[7] ..... E04F 15/04; B27F 1/02

(52) U.S. Cl. ..... 52/589.1; 52/592.2; 52/592.4

(58) Field of Search ..... 52/588.1, 592.1, 52/592.4, 591.1, 589.1, 592.2, 747.1, 747.11, 748.11, 177

(56) References Cited

U.S. PATENT DOCUMENTS

| | | | | |
|---|---|---|---|---|
| 213,740 A | * | 4/1879 | Conner | 52/539 X |
| 714,987 A | | 12/1902 | Wolfe | |
| 753,791 A | | 3/1904 | Fulghum | |
| 1,124,228 A | | 1/1915 | Houston | |
| 1,407,679 A | | 2/1922 | Ruthrauff | |

(List continued on next page.)

FOREIGN PATENT DOCUMENTS

| | | |
|---|---|---|
| AU | 713628 | 1/1998 |
| AU | 200020703 A1 | 6/2000 |
| BE | 417526 | 9/1936 |
| BE | 0557844 | 6/1957 |
| BE | 1010339 A3 | 6/1998 |

(List continued on next page.)

OTHER PUBLICATIONS

Träindustrins Handbook "Snickeriarbete", 2nd Edition, Malmö 1952, pp. 826, 827, 854, and 855, published by Teknografiska Aktiebolaget, Sweden.

"Träbearbetning", Anders Grönlund, 1986, ISBN 91–970513–2–2, pp. 357–360, published by Institute for Trateknisk Forskning, Stockholm, Sweden.

Drawing Figure 25/6107 from Buetec Gmbh dated Dec. 16, 1985.

Pamphlet from Serexhe for Compact–Praxis, entitled "Selbst Teppichböden, PVC und Parkett verlegen", Published by Compact Verlag, München, Germany 1985, pp. 84–87.

(List continued on next page.)

*Primary Examiner*—Laura A. Callo
(74) *Attorney, Agent, or Firm*—Burns, Doane, Swecker & Mathis, L.L.P.

(57) ABSTRACT

The invention relates to a locking system for mechanical joining of floorboards (1, 1') which have a body (30), a lower balancing layer (34) and an upper surface layer (32). A strip (6) is integrally formed with the body (30) of the floorboard (1) and extends under an adjoining floorboard (1'). The strip (6) has a locking element (8), which engages a looking groove (14) in the underside of the adjoining floorboard (1') and forms a horizontal joint. A tongue (38) and a tongue groove (36) form a vertical joint between upper and lower plane-parallel contact surfaces (43, 45) and are designed in such manner that the lower contact surfaces (45) are on a level between the upper side of the locking element (8) and a plane containing the underside (3) of the floorboard. The invention also relates to a floorboard having such a locking system, a floor made of such floorboards, as well as a method for making such a locking system.

37 Claims, 6 Drawing Sheets

*The invention*

U.S. PATENT DOCUMENTS 1,454,250 A 5/1923 Parsons
1,468,288 A 9/1923 Een
1,477,813 A 12/1923 Daniels et al.
1,510,924 A 10/1924 Daniels et al.
1,540,128 A 6/1925 Houston
1,575,821 A 3/1926 Daniels
1,602,256 A 10/1926 Sellin
1,602,267 A 10/1926 Karwisch
1,615,096 A 1/1927 Meyers
1,622,103 A 3/1927 Fulton
1,622,104 A 3/1927 Fulton
1,637,634 A 8/1927 Carter
1,644,710 A 10/1927 Crooks
1,660,480 A 2/1928 Daniels
1,714,738 A 5/1929 Smith
1,718,702 A 6/1929 Pfiester
1,734,826 A 11/1929 Pick
1,764,331 A 6/1930 Moratz
1,778,069 A 10/1930 Fetz
1,787,027 A 12/1930 Wasleff
1,823,039 A 9/1931 Gruner
1,859,667 A 5/1932 Gruner
1,898,364 A 2/1933 Gynn
1,906,411 A 5/1933 Potvin
1,929,871 A 10/1933 Jones
1,940,377 A 12/1933 Storm
1,953,306 A 4/1934 Moratz
1,986,739 A 1/1935 Mitte
1,988,201 A 1/1935 Hall
2,276,071 A 3/1942 Scull
2,324,628 A 7/1943 Kähr
2,398,632 A * 4/1946 Frost et al. ..... 52/539 X
2,430,200 A * 11/1947 Wilson ..... 52/588.1
2,740,167 A * 4/1956 Rowley ..... 52/591.1
2,780,253 A 2/1957 Joa
2,894,292 A 7/1959 Gramelspacher
3,045,294 A 7/1962 Livezey, Jr.
3,100,556 A 8/1963 De Ridder
3,125,138 A 3/1964 Bolenbach
3,182,769 A 5/1965 De Ridder
3,203,149 A 8/1965 Soddy
3,267,630 A 8/1966 Omholt
3,282,010 A 11/1966 King, Jr.
3,310,919 A 3/1967 Bue et al.
3,347,048 A 10/1967 Brown et al.
3,387,422 A 6/1968 Wanzer
3,460,304 A 8/1969 Braeuninger et al.
3,481,810 A 12/1969 Waite
3,526,420 A 9/1970 Brancalcone
3,538,665 A 11/1970 Gohner
3,553,919 A 1/1971 Omholt
3,555,762 A 1/1971 Costanzo, Jr.
3,694,983 A 10/1972 Couquet
3,714,747 A 2/1973 Curran
3,731,445 A 5/1973 Hoffmann et al.
3,759,007 A 9/1973 Thiele
3,768,846 A 10/1973 Hensley et al.
3,859,000 A 1/1975 Webster
3,902,293 A 9/1975 Witt et al.
3,908,053 A 9/1975 Hettich
3,936,551 A 2/1976 Elmendorf et al.
3,988,187 A 10/1976 Witt et al.
4,090,338 A 5/1978 Bourgade
4,099,358 A 7/1978 Compaan
4,169,688 A 10/1979 Toshio
4,242,390 A 12/1980 Nemeth
4,299,070 A 11/1981 Oltmanns et al.
4,426,820 A * 1/1984 Terbrack et al. ..... 52/590.1
4,471,012 A 9/1984 Maxwell
4,501,102 A 2/1985 Knowles
4,561,233 A 12/1985 Harter et al.
4,612,745 A 9/1986 Hovde
4,641,469 A 2/1987 Wood
4,653,242 A 3/1987 Ezard
4,703,597 A 11/1987 Eggemar
4,715,162 A 12/1987 Brightwell
4,738,071 A 4/1988 Ezard
4,769,963 A 9/1988 Meyerson
4,819,932 A 4/1989 Trotter, Jr.
4,831,806 A 5/1989 Niese et al.
4,845,907 A 7/1989 Meek
4,905,442 A 3/1990 Daniels
5,029,425 A 7/1991 Bogataj
5,113,632 A 5/1992 Hanson
5,117,603 A 6/1992 Weintraub
5,165,816 A 11/1992 Parasin
5,179,812 A 1/1993 Hill
5,216,861 A 6/1993 Meyerson
5,253,464 A 10/1993 Nilsen
5,271,564 A 12/1993 Smith
5,295,341 A 3/1994 Kajiwara
5,349,796 A 9/1994 Meyerson
5,390,457 A 2/1995 Sjölander
5,433,806 A 7/1995 Pasquali et al.
5,474,831 A 12/1995 Nystrom
5,497,589 A 3/1996 Porter
5,502,939 A 4/1996 Zadok et al.
5,540,025 A 7/1996 Takehara et al.
5,567,497 A 10/1996 Zegler et al.
5,570,554 A 11/1996 Searer
5,597,024 A 1/1997 Bolyard et al.
5,630,304 A 5/1997 Austin
5,671,575 A 9/1997 Wu
5,706,621 A 1/1998 Pervan
5,768,850 A 6/1998 Chen
5,797,237 A * 8/1998 Finkell, Jr. ..... 52/589.1
5,823,240 A 10/1998 Bolyard et al.
5,827,592 A 10/1998 Van Gulik et al.
5,860,267 A 1/1999 Pervan
5,935,668 A 8/1999 Smith
5,943,239 A 8/1999 Shamblin et al.
5,968,625 A 10/1999 Hudson
5,987,839 A 11/1999 Hamar et al.
6,006,486 A 12/1999 Moriau et al.
6,094,882 A 8/2000 Pervan
6,101,778 A 8/2000 Martensson
6,119,423 A 9/2000 Costantino
6,134,854 A 10/2000 Stanchfield
6,148,884 A 11/2000 Bolyard et al.
6,182,410 B1 2/2001 Pervan
6,205,639 B1 3/2001 Pervan
6,209,278 B1 * 4/2001 Tychsen ..... 52/592.4
6,216,403 B1 4/2001 Belbeoc'h
6,216,409 B1 * 4/2001 Roy et al. ..... 52/589.1
6,324,803 B1 12/2001 Pervan
2001/0034992 A1 * 11/2001 Pletzer et al. ..... 52/589.1 X
2002/0020127 A1 * 2/2002 Thiers et al. ..... 52/589.1 X
2002/0046528 A1 * 4/2002 Pervan et al. ..... 52/588.1

FOREIGN PATENT DOCUMENTS

BE 1010487 A6 10/1998
CA 0991373 6/1976
CA 2226286 12/1997
CA 2252791 5/1999
CA 2289309 7/2000
CH 200949 1/1939
CH 211877 1/1941
DE 1 212 275 3/1966
DE 7102476 1/1971
DE 1534278 11/1971
DE 7402354 1/1974

| | | | | |
|---|---|---|---|---|
| DE | 2 238 660 | | | 2/1974 |
| DE | 2 252 643 | | | 5/1974 |
| DE | 2502992 | | | 7/1976 |
| DE | 2616077 | | | 10/1977 |
| DE | 2917025 | | | 11/1980 |
| DE | 30 41781 | A1 | | 6/1982 |
| DE | 32 14 207 | A1 | | 11/1982 |
| DE | 32 46 376 | C2 | | 6/1984 |
| DE | 3343601 | A1 | | 6/1985 |
| DE | 8604004 | | | 6/1986 |
| DE | 3512204 | A1 | | 10/1986 |
| DE | 3544845 | A1 | | 6/1987 |
| DE | 40 02 547 | A1 | | 8/1991 |
| DE | 4134452 | A1 | | 4/1993 |
| DE | 4215273 | A1 | | 11/1993 |
| DE | 4242530 | A1 | | 6/1994 |
| DE | 29710175 | U1 | | 9/1997 |
| DE | 19651149 | A1 | | 6/1998 |
| DE | 196 51 149 | A1 | | 6/1998 |
| DE | 197 09 641 | A1 | | 9/1998 |
| DE | 200 01 225 | U1 | | 8/2000 |
| DE | 199 25 248 | A1 | | 12/2000 |
| DE | 200 17 461 | U1 | | 3/2001 |
| DE | 200 18 284 | U1 | | 3/2001 |
| EP | 0248127 | A1 | | 12/1987 |
| EP | 0 623 724 | A1 | | 11/1994 |
| EP | 0652340 | A1 | | 5/1995 |
| EP | 0 690 185 | A1 | | 1/1996 |
| EP | 0698162 | B1 | | 2/1996 |
| EP | 0843763 | B1 | | 5/1998 |
| EP | 0849416 | A2 | | 6/1998 |
| EP | 0855482 | B1 | | 7/1998 |
| EP | 0877130 | B1 | | 11/1998 |
| EP | 0958441 | | | 11/1998 |
| EP | 0903451 | A2 | | 3/1999 |
| EP | 0969163 | A2 | | 1/2000 |
| EP | 0969163 | A3 | | 1/2000 |
| EP | 0969164 | A2 | | 1/2000 |
| EP | 0969164 | A3 | | 1/2000 |
| EP | 0974713 | A1 | | 1/2000 |
| FI | 843060 | | | 8/1984 |
| FR | 1293043 | | | 4/1962 |
| FR | 2 568 295 | | | 1/1986 |
| FR | 2630149 | | | 10/1989 |
| FR | 2 637 932 | A1 | | 4/1990 |
| FR | 2675174 | | | 10/1992 |
| FR | 2691491 | | | 11/1993 |
| FR | 2 697 275 | | | 4/1994 |
| FR | 2 712 329 | A1 | | 5/1995 |
| FR | 2 781 513 | A1 | | 1/2000 |
| FR | 2 785 633 | A1 | | 5/2000 |
| GB | 424057 | | | 2/1935 |
| GB | 585205 | | | 1/1947 |
| GB | 599793 | | | 3/1948 |
| GB | 636423 | | | 4/1950 |
| GB | 812671 | | | 4/1959 |
| GB | 1127915 | | | 10/1968 |
| GB | 1237744 | | | 6/1971 |
| GB | 1275511 | | | 5/1972 |
| GB | 1430423 | | | 3/1976 |
| GB | 2117813 | A | | 10/1983 |
| GB | 2 126 106 | A | | 3/1984 |
| GB | 2243381 | A | | 10/1991 |
| GB | 2256023 | | * | 11/1992 |
| GB | 2256023 | A | | 11/1992 |
| JP | 54-65528 | | | 5/1979 |
| JP | 57-119056 | | | 7/1982 |
| JP | 3-169967 | | | 7/1991 |
| JP | 5-148984 | | | 6/1993 |
| JP | 6-56310 | | | 5/1994 |
| JP | 6-146553 | A | | 5/1994 |
| JP | 6-320510 | A | | 11/1994 |
| JP | 7-076923 | A | | 3/1995 |
| JP | 7-180333 | A | | 7/1995 |
| JP | 7-300979 | A | | 11/1995 |
| JP | 7-310426 | A | | 11/1995 |
| NL | 7601773 | | | 8/1976 |
| NO | 157871 | | | 7/1984 |
| NO | 305614 | | | 5/1995 |
| PL | 24931 | U | | 11/1974 |
| SE | 372 051 | | | 5/1973 |
| SE | 450 141 | | | 6/1984 |
| SE | 512290 | | | 12/1990 |
| SE | 501 014 | C2 | | 10/1994 |
| SE | 502994 | | | 3/1996 |
| SE | 506 254 | C2 | | 11/1997 |
| SE | 509059 | | | 6/1998 |
| SE | 509060 | | | 6/1998 |
| SE | 512313 | | | 12/1999 |
| SE | 0000200-6 | | | 7/2001 |
| SU | 363795 | | | 11/1973 |
| WO | Wo 84/02155 | | | 6/1984 |
| WO | WO87/03839 | A1 | | 7/1987 |
| WO | WO 92/17657 | | | 10/1992 |
| WO | WO 93/13280 | | | 7/1993 |
| WO | WO 94/01628 | | | 1/1994 |
| WO | WO 94/26999 | | * | 11/1994 |
| WO | WO 96/27719 | | * | 9/1996 |
| WO | WO 96/27721 | | | 9/1996 |
| WO | WO96/30177 | A1 | | 10/1996 |
| WO | WO 97/47834 | | * | 12/1997 |
| WO | WO 98/24994 | | | 6/1998 |
| WO | WO 98/24995 | | | 6/1998 |
| WO | WO98/38401 | | | 9/1998 |
| WO | WO99/40273 | A1 | | 8/1999 |
| WO | WO 99/66151 | | | 12/1999 |
| WO | WO99/66151 | A1 | | 12/1999 |
| WO | WO 99/66152 | | | 12/1999 |
| WO | WO 00/06854 | | | 1/2000 |
| WO | WO00/66856 | A1 | | 11/2000 |

OTHER PUBLICATIONS

Pamphlet from Junckers Industrser A/S entitled "B0jlesystemet til Junckers bøliggulve" Oct. 1994, , Published by Junckers Industrser A/S, Denmark.

Pamphlet from Junckers Industrser A/S entitled "The Clip System for Junckers Sports Floors", Annex 7, 1994, Published by Junckers Industrser A/S, Denmark.

Pamphlet from Junckers Industrser A/S entitled "The Clip System for Junckers Domestic Floors", Annex 8, 1994, Published by Junckers Industrser A/S, Denmark.

Fibo–Trespo Alloc System Brochure entitled "Opplæring OG Autorisasjon", pp. 1–29, Fibo–Trespo.

"Revolution bei der Laminatboden–Verl", boden wand decke, vol. No. 11 of 14, Jan. 10, 1997, p. 166.

Kährs Focus Extra dated Jan. 2001, pp. 1–9.

Brochure for CLIC Laminate Flooring, Art.–Nr. 110 11 640.

Brochure for Laminat–Boden "Clever–Click", Parador® Wohnsysteme.

Brochure for PERGO®, CLIC Laminate Flooring, and Prime Laminate Flooring from Bauhaus, The Home Store, Malmö, Sweden.

Webster's Dictionary, Random House: New York (1987), p. 862.

Knight's American Mechanical Dictionary, Hurd and Houghton: New York (1876), p. 2051.

Opposition EP 0.698,162 B1—Facts–Grounds–Arguments, dated Apr. 1, 1999, pp. 1–56.

Opposition II EP 0.698,162 B1—Facts–Grounds–Arguments, dated Apr. 30, 1999, (17 pages)—with translation (11 pages).
Opposition I: Unilin Decor N.V./Välinge Aluminum AB, communication dated Jun. 8, 1999 to European Patent Office, pp. 1–2.
Opposition I: Unilin Decor N.V./Välinge Aluminum AB, communication dated Jun. 16, 1999 to European Patent Office, pp. 1–2.
FI Office Action dated Mar. 19, 1998.
NO Office Action dated Dec. 22, 1997.
NO Office Action dated Sep. 21, 1998.
Opposition EP 0.877.130 B1—Arguments, dated Jun. 28, 2000, pp. 1–13.
RU Application Examiner Letter dated Sep. 26, 1997.
NZ Application Examiner Letter dated Oct. 21, 1999.
Välinge, Fibo–Trespo Brochure, Distributed at the Domotex Fair In Hannover, Germany, Jan. 1996.
Pergo, Inc. v. Välinge Aluminium AB, Berry Finance NV, and Alloc, Inc.; U.S. District Court for the District of Columbia; Civil Action No. 1:00CV01618.
Alloc, Inc. v. Unilin Decor NV and BHK of America, Inc.; U.S. District Court for the Eastern District of Wisconsin; Civil Action No. 00–C–0999.
Unilin Beheer B.V., Unilin Decor, N.V., and BHK of America, Inc. v. Välinge Aluminium AB; U.S. District Court for the District of Columbia; Civil Action No. 1:00CV01823.
Alloc, Inc., Berry Finance NV, and Välinge Aluminium AB v. Unilin Decor NV, BHK of America, Inc., Pergo, Inc., Meister–Leisten Schulte GmbH, Akzenta Paneele+Profile GmbH, Tarkett, Inc., and Roysol; ITC No. 337–TA–443 (Docket No. 2154) Filed Dec. 4, 2000.
Alloc, Inc., Berry Finance NV, and Välinge Aluminium AB v. Tarkett, Inc.; U.S. District Court for the Eastern District of Wisconsin; Civil Action No. 00–CV–1377.

European prosecution file history to grant, European Patent No. 94915725.9—2303/0698162, grant date Sep. 16, 1998.

European prosecution file history to grant, European Patent No. 98106535.2–2303/0855482, grant date Dec. 1, 1999.

European prosecution file history to grant, European Patent No. 98201555.4–2303/0877130, grant date Jan. 26, 2000.

Communication of Notices of Intervention by E.F.P. Floor Products dated Mar. 17, 2000 in European Patent Application 0698162, pp. 1–11 with annex pp. 1–21.

Response to the E.F.P. Floor Products intervention dated Jun. 28, 2000, pp. 1–5.

Letters from the Opponent dated Jul. 26, 2001 and Jul. 30, 2001 including Annexes 1 to 3.

Communication from European Patent Office dated Sep. 20, 2001 in European Patent No. 0698162, pp. 1–2 with Facts and Submissions Annex pp. 1–18, Minutes Annex pp. 1–11, and Annex I to VI.

Communication from Swedish Patent Office dated Sep. 21, 2001 in Swedish Patent No. 9801986–2, pp. 1–3 in Swedish with forwarding letter dated Sep. 24, 2001 in English.

* cited by examiner

Prior-art technique

Prior-art technique

Prior-art technique

Prior-art technique

Prior-art technique - Substantially according to Fiboloc -NSF and WO 9966151

The invention

LOCKING SYSTEM FOR MECHANICAL JOINING OF FLOORBOARDS AND METHOD FOR PRODUCTION THEREOF

This application is a continuation of International Application No. PCT/SE01/00125 filed on Jan. 24, 2001, which International Application was published by the International Bureau in English on Jul. 26, 2001. The entire contents of PCT/SE01/00125 are hereby incorporated herein by reference.

TECHNICAL FIELD

The invention generally relates to the field of mechanical locking of floorboards. The invention relates to an improved locking system for mechanical locking of floorboards, a floorboard provided with such an improved locking system, a flooring made of such mechanically joined floorboards, and a method for making such floorboards. The invention generally relates to an improvement of a locking system of the type described and shown in WO 94/26999 and WO 99/66151.

More specifically, the invention relates to a locking system for mechanical joining of floorboards of the type having a body and preferably a surface layer on the upper side of the body and a balancing layer on the rear side of the body, said locking system comprising: (i) for horizontal joining of a first and a second joint edge portion of a first and a second floorboard respectively at a vertical joint plane, on the one hand a locking groove which is formed in the underside of said second board and extends parallel with and at a distance from said vertical joint plane at said second joint edge and, on the other hand, a strip integrally formed with the body of said first board, which strip at said first joint edge projects from said vertical joint plane and supports a locking element, which projects towards a plane containing the upper side of said first floorboard and which has a locking surface for coaction with said locking groove, and (ii) for vertical joining of the first and second joint edge, on the one hand a tongue which at least partly projects and extends from the joint plane and, on the other hand, a tongue groove adapted to coact with said tongue, the first and second floorboards within their joint edge portions for the vertical joining having coacting upper and coacting lower contact surfaces, of which at least the upper comprise surface portions in said tongue groove and said tongue.

FIELD OF APPLICATION OF THE INVENTION

The present invention is particularly suitable for mechanical joining of thin floating floorboards made up of an upper surface layer, an intermediate fibreboard body and a lower balancing layer, such as laminate flooring and veneer flooring with a fibreboard body. Therefore, the following description of the state of the art, problems associated with known systems, and the objects and features of the invention will, as a non-restricting example, focus on this field of application and, in particular, on rectangular floorboards with dimensions of about 1.2 m* 0.2 m and a thickness of about 7–10 mm, intended to be mechanically joined at the long side as well as the short side.

BACKGROUND OF THE INVENTION

Thin laminate flooring and wood veneer flooring are usually composed of a body consisting of a 6–9 mm fibreboard, a 0.20–0.8 mm thick upper surface layer and a 0.1–0.6 mm thick lower balancing layer. The surface layer provides appearance and durability to the floorboards. The body provides stability and the balancing layer keeps the board level when the relative humidity (RH) varies during the year. The RH can vary between 15% and 90%. Conventional floorboards of the type are usually joined by means of glued tongue-and-groove joints (i.e. joints involving a tongue on a floorboard and a tongue groove on an adjoining floorboard) at the long and short sides. When laying the floor, the boards are brought together horizontally, whereby a projecting tongue along the joint edge of a first board is introduced into a tongue groove along the joint edge of the second adjoining board. The same method is used at the long side as well as the short side. The tongue and the tongue groove are designed for such horizontal joining only and with special regard to how glue pockets and gluing surfaces should be designed to enable the tongue to be efficiently glued within the tongue groove. The tongue-and-groove joint presents coacting upper and lower contact surfaces that position the boards vertically in order to ensure a level surface of the finished floor.

In addition to such conventional floors, which are connected by means of glued tongue-and-groove joints, floorboards have recently been developed which are instead mechanically joined and which do not require the use of glue. This type of mechanical joint system is hereinafter referred to as a "strip-lock system", since the most characteristic component of this system is a projecting strip which supports a locking element.

WO 94/26999 and WO88/66151 (owner Välinge Aluminium AB) disclose a strip-lock system for joining building panels, particularly floorboards. This locking system allows the boards to be locked mechanically at right angles to as well as parallel with the principal plane of the boards at the long side as well as at the short side. Methods for making such floorboards are disclosed in EP 0958441 and EP 0958442 (owner Välinge Aluminium AB). The basic principles of the design and the installation of the floorboards, as well as the methods for making the same, as described in the four above-mentioned documents are usable for the present invention as well, and therefore these documents are hereby incorporated by reference.

In order to facilitate the understanding and description of the present invention, as well as the comprehension of the problems underlying the invention, brief description of the basic design and function of the known floorboards according to the above-mentioned WO 94/26999 and WO 99/66151 will be given below with reference to FIGS. 1–3 in the accompanying drawings. Where applicable, the following description of the prior art also applies to the embodiments of the present invention described below.

FIGS. 3*a* and 3*b* are thus a top view and a bottom view respectively of a known floorboard 1. The board 1 is rectangular with a top side 2, an underside 3, two opposite long sides 4*a*, 4*b* forming joint edge portions and two opposite short sides 5*a*, 5*b* forming joint edge portions.

Without the use of the glue, both the long sides 4*a*, 4*b* and the short sides 5*a*, 5*b* can be joined mechanically in a direction D2 in FIG. 1*c*, so that they join in a joint plane F (marked in FIG. 2*c*). For this purpose, the board 1 has a flat strip 6, mounted at the factory, projecting horizontally from its one long side 4*a*, which strip extends throughout the length of the long side 4*a* and which is made of flexible, resilient sheet aluminium. The strip 6 can be fixed mechanically according to the embodiment shown, or by means of glue, or in some other way. Other strip materials can be used, such as sheets of other metals, as well as aluminium or plastic sections. Alternatively, the strip 6 may be made in one piece with the board 1, for example by suitable working of the body of the board 1. The present invention is usable for floorboards in which the strip is integrally formed with the body and solves special problems appearing in such floorboards and the making thereof. The body of the floorboard need not be, but is preferably, made of a uniform material. However, the strip 6 is always integrated with the board 1, i.e. it is never mounted on the board 1 in connection with the laying of the floor but it is mounted or formed at the factory. The width of the strip 6 can be about 30 mm and its thickness about 0.5 mm. A similar, but shorter strip 6 is provided along one short side 5*a* of the board 1. The part of the strip 6 projecting from the joint plane F is formed with a locking element 8 extended throughout the length of the strip 6. The locking element 8 has an operative locking surface 10 facing the joint plane F and having a height of e.g. 0.5 mm. When the floor is being laid, this locking surface 10 coacts with a locking groove 14 formed in the underside 3 of the joint edge portion 4*b* of the opposite long side of an adjoining board 1'. The short side strip 6' is provided with a corresponding locking element 8', and the joint edge portion 5*b* of the opposite short side has a corresponding locking groove 14'. The edge of the locking grooves 14, 14' facing away from the joint plane F forms an operative locking surface 10' for coaction with the operative locking surface 10 of the locking element.

Moreover, for mechanical joining of both long sides and short sides also in the vertical direction (direction D1 in FIG. 1*c*) the board is formed with a laterally open recess 16 along one long side (joint edge portion 4*a*) and one short side (joint edge portion 5*a*). At the bottom, the recess 16 is defined by the respective strips 6, 6'. At the opposite edge portions 4*b* and 5*b* there is an upper recess 18 defining a locking tongue 20 coacting with the recess 16 (see FIG. 2*a*).

FIGS. 1*a*–1*c* show how two long sides 4*a*, 4*b* of two such boards 1, 1' on an underlay 12 can be joined together by means of downward angling. FIGS. 2*a*–2*c* show how the short sides 5*a*, 5*b* of the boards 1, 1' can be joined together by snap action. The long sides 4*a*, 4*b* can be joined together by means of both methods, while the short sides 5*a*, 5*b*—when the first row has been laid—are normally joined together subsequent to joining together the long sides 4*a*, 4*b* and by means of snap action only.

When a new board 1' and a previously installed board 1 are to be joined together along their long sides 4*a*, 4*b* as shown in FIGS. 1*a*–1*c*, the long side 4*b* of the new board 1' is pressed against the long side 4*a* of the previous board 1 as shown in FIG. 1*a*, so that the locking tongue 20 is introduced into the recess 16. The board 1' is then angled downwards towards the subfloor 12 according to FIG. 1*b*. In this connection, the locking tongue 20 enters the recess 16 completely, while the locking element 8 of the strip 6 enters the locking groove 14. During this downward angling the upper part 9 of the locking element 8 can be operative and provide guiding of the new board 1' towards the previously installed board 1. In the joined position as shown in FIG. 1*c*, the boards 1, 1' are locked in both the direction D1 and the direction D2 along their long sides 4*a*, 4*b*, but the boards 1, 1' can be mutually displaced in the longitudinal direction of the joint along the long sides 4*a*, 4*b*.

FIGS. 2*a*–2*c* show how the short sides 5*a* and 5*b* of the boards 1, 1' can be mechanically joined in the direction D1 as well as the direction D2 by moving the new board 1' towards the previously installed board 1 essentially horizontally. Specifically, this can be carried out subsequent to joining the long side of the new board 1' to a previously installed board 1 in an adjoining row by means of the method according to FIGS. 1*a*–1*c*. In the first step in FIG. 2*a*, bevelled surfaces adjacent to the recess 16 and the locking tongue 20 respectively cooperate such that the strip 61 is forced to move downwards as a direct result of the bringing together of the short sides 5*a*, 5*b*. During the final bringing together of the short sides, the strip 6' snaps up when the locking element 8' enters the locking groove 14', so that the operative locking surfaces 10, 10' of the locking element 8' and of the locking groove 14' will engage each other.

By repeating the steps shown in FIGS. 1*a*–*c* and 2*a*–*c*, the whole floor can be laid without the use of glue and along all joint edges. Known floorboards of the above-mentioned type are thus mechanically joined usually by first angling them downwards on the long side, and when the long side has been secured, snapping the short sides together by means of horizontal displacement of the new board 1' along the long side of the previously installed board 1. The boards 1, 1' can be taken up in the reverse order of laying without causing any damage to the joint, and be laid again. These laying principles are also applicable to the present invention.

For optimal function, subsequent to being joined together, the boards should be capable of assuming a position along their long sides in which a small play can exist between the operative locking surface 10 of the locking element and the operative locking surface 10' of the locking groove 14. Reference is made to WO 94/26999 for a more detailed description of this play.

In addition to what is known from the above-mentioned patent specifications, a licensee of Välinge Aluminium AB, Norske Skog Flooring AS, Norway (NSF), introduced a laminated floor with mechanical joining according to WO 94/26999 in January 1996 in connection with the Domotex trade fair in Hannover, Germany. This laminated floor, which is marketed under the trademark Alloc®, is 7.2 mm thick and has a 0.6-mm aluminium strip 6 which is mechanically attached on the tongue side. The operative locking surface 10 of the locking element 8 has an inclination (hereinafter termed locking angle) of about 80° to the plane of the board. The vertical connection is designed as a modified tongue-and-groove joint, the term "modified" referring to the possibility of bringing the tongue groove and tongue together by way of angling.

WO 97/47834 (owner Unilin Beeher B.V., the Netherlands) describes a strip-lock system which has a fibreboard strip and is essentially based on the above known principles. In the corresponding product, "Uniclic®", which this owner began marketing in the latter part of 1997, one seeks to achieve biasing of the boards. This results in high friction and makes it difficult to angle the boards together and to displace them. The document shows several embodiments of the locking system. The "Uniclic®" product is shown in section in FIG. 4*b*.

Other known locking systems for mechanical joining of board materials are described in, for example, GB-A2,256,023 showing unilateral mechanical joining for providing an expansion joint in a wood panel for outdoor use, and in U.S. Pat. No. 4,426,820 (shown in FIG. 4*d*) which concerns a mechanical locking system for plastic sports floors, which floor is intentionally designed in such manner that neither displacement of the floorboards along each other nor locking of the short sides of the floorboards by snap action is allowed.

In the autumn of 1998, NSF introduced a 7.2-mm laminated floor with a strip-lock system which comprises a fibreboard strip and is manufactured according to WO 94/26999 and WO 99/66151. This laminated floor is marketed under the trademark "Fiboloc®" and has the cross-section illustrated in FIG. 4*a*.

In January 1999, Kronotex GmbH, Germany, introduced a 7.8 mm thick laminated floor with a strip lock under the trademark "Isilock®". A cross-section of the joint edge portion of this system is shown in FIG. 4*c*. Also in this floor, the strip is composed of fibreboard and a balancing layer.

During 1999, the mechanical joint system has obtained a strong position on the world market, and some twenty manufacturers have shown, in January 2000, different types of systems which essentially are variants of Fiboloc®, Uniclic® and Isilock®.

SUMMARY OF THE INVENTION

Although the floor according to WO 94/26999 and WO 99/66151 and the floor sold under the trademark Fiboloc® exhibit major advantages in comparison with traditional, glued floors, further improvements are desirable mainly in thin floor structures.

The joint system consists of three parts. An upper part P1 which takes up the load on the floor surface in the joint. An intermediate part P2 that is necessary for forming the vertical joint in the D1 direction in the form of tongue and tongue groove. A lower part P3 which is necessary for forming the horizontal lock in the D2 direction with strip and locking element.

In thin floorboards, it is difficult to provide, with prior-art technique, a joint system which at the same time has a sufficiently high and stable upper part, a thick, strong and rigid tongue and a sufficiently thick strip with a high locking element. Nor does a joint system according to FIG. 4*d*, i.e. according to U.S. Pat. No. 4,426,820, solve the problem since a tongue groove with upper and lower contact surfaces which are parallel with the upper side of the floorboard or the floor plane, cannot be manufactured using the milling tools which are normally used when making floorboards. The rest of the joint geometry in the design according to FIG. 4*d* cannot be manufactured by working a wood-based board since all surfaces abut each other closely, which does not provide space for manufacturing tolerances. Moreover, strip and locking elements are dimensioned in a manner that requires considerable modifications of the joint edge portion that is to be formed with a locking groove.

At present there are no known products or methods which afford satisfactory solutions to problems that are related to thin floorboards with mechanical joint systems. It has been necessary to choose compromises which (i) either result in a thin tongue and sufficient material thickness in the joint edge portion above the corresponding tongue groove in spite of plane-parallel contact surfaces or (ii) use upper and lower contact surfaces angled to each other and downwardly extending projections and corresponding recesses in the tongue and the tongue groove respectively of adjoining floorboards or (iii) result in a thin and mechanically weak locking strip with a locking element of a small height.

Therefore an object of the present invention is to obviate this and other drawbacks of prior art. Another object of the invention is to provide a locking system, a floorboard, and a method for making a floorboard having such a locking system, in which it is at the same time possible to obtain (i) a stable joint with tongue and tongue groove, (ii) a stable portion of material above the tongue groove, (iii) a strip and a locking element, which have high strength and good function.

To achieve these criteria simultaneously, it is necessary to take the conditions into consideration which are present in the manufacture of floorboards with mechanical locking systems. The problems arise mainly when laminate-type thin floorboards are involved, but the problems exist in all types of thin floorboards. The three contradictory criteria will be discussed separately in the following.

(i) Tongue-and-Groove Joint

If the floor is thin there is not sufficient material for making a tongue groove and a tongue of sufficient thickness for the intended properties to be obtained. The thin tongue will be sensitive to laying damage, and the strength of the floor in the vertical direction will be insufficient. If one tries to improve the properties by making the contact surfaces between tongue and tongue groove oblique instead of parallel with the upper side of the floorboard, the working tools must during working be kept extremely accurately positioned both vertically and horizontally relative to the floorboard that is being made. This means that the manufacture will be significantly more difficult, and that it will be difficult to obtain optimal and accurate fitting between tongue and tongue groove. The tolerances in manufacture must be such that a fitting of a few hundredths of a millimetre is obtained since otherwise it will be difficult or impossible to displace the floorboards parallel with the joint edge in connection with the laying of the floorboards.

(ii) Material Portion Above the Tongue Groove

In a mechanical locking system glue is not used to keep tongue and tongue groove together in the laid floor. At a low relative humidity the surface layer of the floorboards shrinks, and the material portion that is located above the tongue groove and consequently has no balancing layer on its underside, can in consequence be bent upwards if this material portion is thin. Upwards bending of this material portion may result in a vertical displacement between the surface layers of adjoining floorboards in the area of the joint and causes an increased risk of wear and damage to the joint edge. To reduce the risk of upwards bending, it is therefore necessary to strive to obtain as thick a material portion as possible above the tongue groove. With known geometric designs of locking systems for mechanical joining of floorboards, it is then necessary to reduce the thickness of the tongue and tongue groove in the vertical direction of the floorboard if at the same time efficient manufacture with high and exact tolerances is to be carried out. A reduced thickness of tongue and tongue groove, however, results in, inter alia, the drawbacks that the strength of the joint perpendicular to the plane of the laid floor is reduced and that the risk of damage caused during laying increases.

(iii) Strip and Locking Element

The strip and the locking element are formed in the lower portion of the floorboard. If the total thickness of a thin floorboard is to be retained and at the same time a thick material portion above the locking groove is desirable, and locking element and strip are to be formed merely in that part of the floorboard which is positioned below the tongue groove, the possibilities of providing a strip having a locking element with a sufficiently high locking surface and upper guiding part will be restricted in an undesirable manner. The strip closest to the joint plane and the lower part of the tongue groove can be too thick and rigid and this makes the locking by snap action by backwards bending of the strip difficult. If at the same time the material thickness of the strip is reduced and a large part of the lower contact surface is retained in the tongue groove, this results on the other hand in a risk that the floorboard will be damaged while being laid or subsequently removed.

A problem that is also to be taken into consideration in the manufacture of floorboards, in which the components of the locking system—tongue/tongue groove and strip with a locking element engaging a locking groove—are to be made by working the edge portions of a board-shaped starting material, is that it must be possible to guide the tools in an easy way and position them correctly and with an extremely high degree of accuracy in relation to the board-shaped starting material. Guiding of a chip-removing tool in more than one direction means restrictions in the manufacture and also causes a great risk of reduced manufacturing tolerances and, thus, a poorer function of the finished floorboards.

To sum up, there is a great need for providing a locking system which takes the above-mentioned requirements, problems and desiderata into consideration to a greater extent than prior art. The invention aims at satisfying this need.

These and other objects of the invention are achieved by a locking system, a floorboard, a floor and a manufacturing method having the features stated in the independent claims. The dependent claims define particularly preferred embodiments of the invention.

The invention is based on a first understanding that the identified problems must essentially be solved with a locking system where the lower contact surface of the tongue groove is displaced downwards and past the upper part of the locking element.

The invention is also based on a second understanding which is related to the manufacturing technique, viz. that the tongue groove must be designed in such manner that it can be manufactured rationally and with extremely high precision using large milling tools which are normally used in floor manufacture and which, during their displacement relative to the joint edge portions of the floorboard that is to be made, need be guided in one direction only to provide the parallel contact surfaces while the tool is displaced along the joint edge portion of the floorboard material (or alternatively the joint edge portion is displaced relative to the tool). In known designs of the joint edge portions, such working requires in most cases guiding in two directions while at the same time a relative displacement of tool and floorboard material takes place.

According to a first aspect of the invention, a locking system is provided of the type which is stated by way of introduction and which according to the invention is characterised by the combination by the combination that the upper and lower contact surfaces are essentially plane-parallel and extend essentially parallel with a plane containing the upper side of the floorboards, and that the upper edge of the locking element, which upper edge is closest to a plane containing the upper side of the floorboards, is located in a horizontal plane, which is positioned between the upper and the lower contact surfaces but closer to the lower than the upper contact surfaces.

According to another aspect of the invention, a new manufacturing method for making strip and tongue groove is provided. According to conventional methods, the tongue groove is always made by means of a single tool. The tongue groove according to the invention is made by means of two tools in two steps where the lower part of the tongue groove and its lower contact surface are made by means of one tool and the upper part of the tongue groove and its upper contact surface are made by means of another tool. The method according to the invention comprises the steps 1) of forming part of the strip, part of the lower part of the tongue groove and the lower contact surface by means of an angled milling tool operating at an angle <90° to the horizontal plane of the floorboard and the strip, and 2) forming the upper part of the tongue groove and the upper contact surface by means of a separate horizontally operating tool.

According to another aspect of the invention, also a method for making a locking system and floorboards of the above type with plane-parallel upper and lower contact surfaces is provided. This method is characterised in that parts of said tongue groove and at least parts of the lower contact surface are formed by means of a chip-removing tool, whose chip-removing surface portions are brought into removing contact with the first joint portion and are directed obliquely inwards and past said joint plane and that the upper contact surface and parts of the tongue groove are formed by means of a chip-removing tool, whose chip-removing surface portions are moved into removing contact with the first joint portion in a plane which is essentially parallel with a plane containing the upper side of the floorboard.

DESCRIPTION OF PREFERRED EMBODIMENTS

Prior to the description of preferred embodiments, with reference to FIG. 5, a detailed explanation will first be given of the most important parts in a strip lock system.

Figure 5:
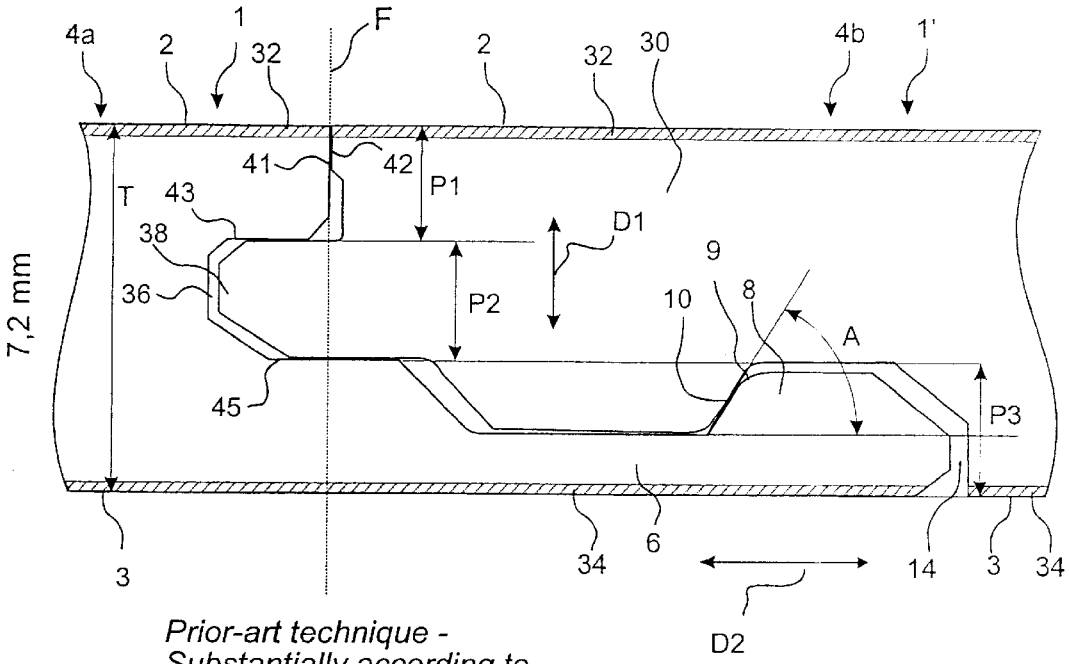
FIG. 5 shows a strip lock for joining of long sides of floorboards, where the different parts of the joint system are made in three levels P1, P2 and P3 as shown and described in WO 99/66151.

The cross-sections shown in FIG. 5 are hypothetical, not published cross-sections, but they are fairly similar to the locking system of the known floorboard "Fiboloc®" and to the locking system according to WO 99/66151. Accordingly, FIG. 5 does not represent the invention. Parts corresponding to those in the previous Figures are in most cases provided with the same reference numerals. The construction, function and material composition of the basic components of the boards in FIG. 5 are essentially the same as in embodiments of the present invention, and consequently, where applicable, the following description of FIG. 5 also applies to the subsequently described embodiments of the invention.

In the embodiment shown, the boards 1, 11 in FIG. 5 are rectangular with opposite long sides 4*a*, 4*b* and opposite short sides 5*a*, 5*b*. FIG. 5 shows a vertical cross-section of a part of a long side 4*a* of the board 1, as well as a part of a long side 4*b* of an adjoining board 1'. The bodies of the boards 1 can be composed of a fibreboard body 30, which supports a surface layer 32 on its front side and a balancing layer 34 on its rear side (underside). A strip 6 is formed from the body and balancing layer of the floorboard and supports a locking element 8. Therefore the strip 6 and the locking element 8 in a way constitute an extension of the lower part of the tongue groove 36 of the floorboard 1. The locking element 8 formed on the strip 6 has an operative locking surface 10 which cooperates with an operative locking surface 10' in a locking groove 14 in the opposite joint edge 4*b* of the adjoining board 1'. By the engagement between the operative locking surfaces 10, 10' a horizontal locking of the boards 1, 1' transversely of the joint edge (direction D2) is obtained. The operative locking surface 10 of the locking element 8 and the operative locking surface 10' of the locking groove form a locking angle A with a plane parallel with the upper side of the floorboards. This locking angle is <90°, preferably 55–85°. The upper part of the locking element has a guiding part 9 which, when angled inwards, guides the floorboard to the correct position. The locking element and the strip have a relative height P3.

To form a vertical lock in the D1 direction, the joint edge portion 4*a* has a laterally open tongue groove 36 and the opposite joint edge portion 4*b* has a laterally projecting tongue 38 which in the joined position is received in the tongue groove 36. The upper contact surfaces 43 and the lower contact surfaces 45 of the locking system are also plane and parallel with the plane of the floorboard.

In the joined position according to FIG. 5, the two juxtaposed upper joint edge portions 41 and 42 of the boards 1, 1' define a vertical joint plane F. The tongue groove has a relative height P2 and the material portion above the upper contact surface 43 of the tongue groove has a relative height P1 up to the upper side 32 of the floorboard. The material portion of the floorboard below the tongue groove has a relative height P3. Also the height of the locking element 8 corresponds to approximately the height P3. The thickness of the floorboard therefore is T=P1+P2+P3.

Figure 2A:
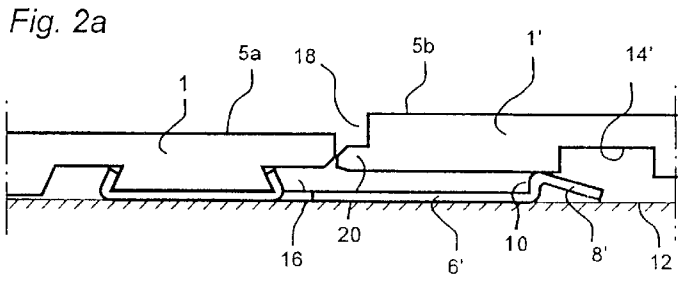
FIGS. 2*a–c* show in three stages a snap-action method for mechanical joining of short sides of floorboards according to WO 94/26999.
Figure 2B:
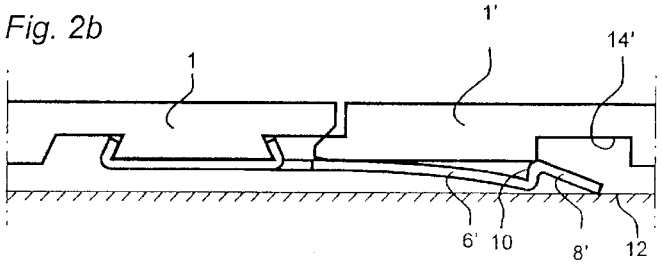
Figure 2C:
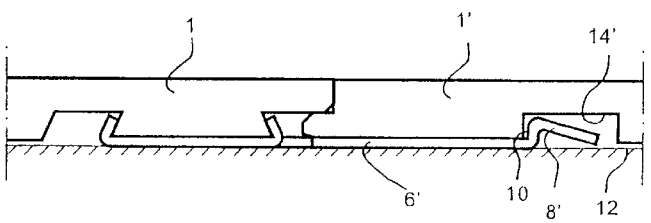
Figure 1A:
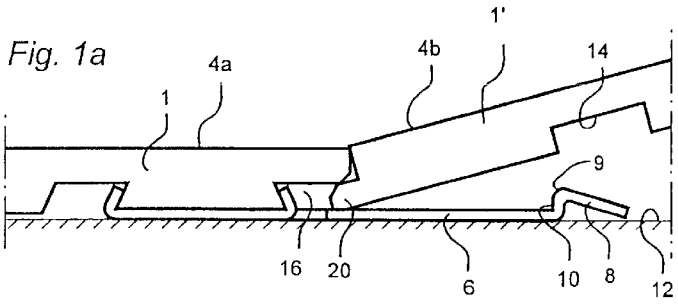
FIGS. 1*a–c* show in three stages a downward angling method for mechanical joining of long sides of floorboards according to WO 94/26999.
Figure 6:
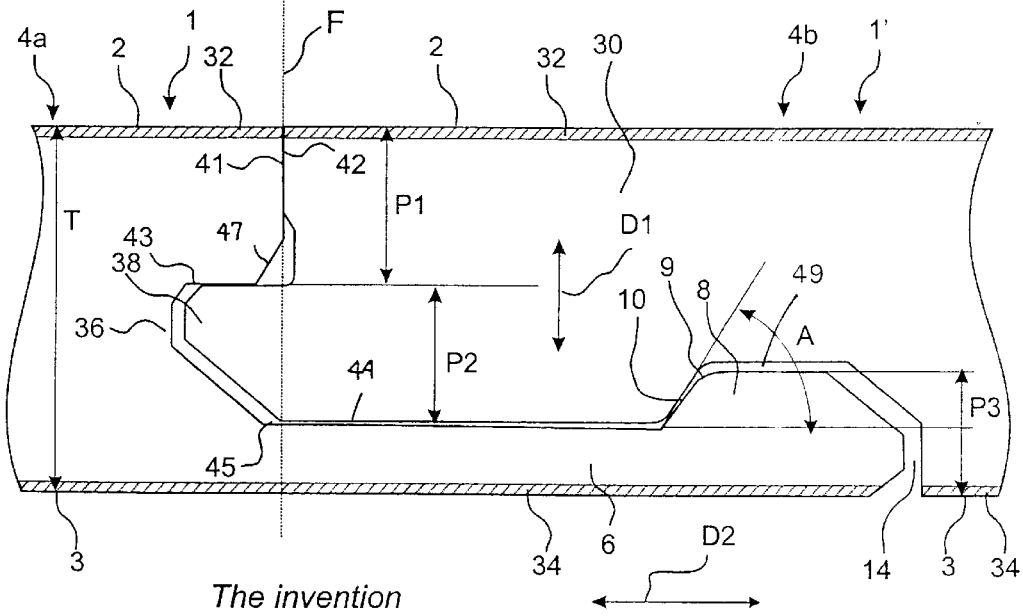
FIG. 6 shows parts of two joined floorboards which have been formed with a locking system according to the present invention.

FIG. 6 shows an example of an embodiment according to the invention, which differs from the embodiment in FIG. 5 by the tongue 38 and the tongue groove 36 being displaced downwards in the floorboard so that they are eccentrically positioned. Moreover, the thickness of the tongue 38 (and, thus, the tongue groove 36) has been increased while at the same time the relative height of the locking element 8 has been retained at approximately P3. Both the tongue 38 and the material portion above the tongue groove 36 are therefore significantly more rigid and stronger while at the same time the floor thickness T, the outer part of the strip 6 and the locking element 8 are unchanged. In the invention, the lower contact surface 45 has been displaced outwards to be positioned essentially outside the tongue groove 36 and outside the joint plane F on the upper side of the strip 6. By the inclination of the underside 44 of the outer part of the tongue, the tongue 38 will thus engage the lower contact surface at, or just outside, the joint plane F. Moreover, the tongue groove 36 extends further into the floorboard 1 than does the free end of the tongue 38 in the mounted state, so that there is a gap 46 between tongue and tongue groove. This gap 46 facilitates the insertion of the tongue 38 into the tongue groove 36 when being angled inwards similarly to that shown in FIG. 1*a*. Moreover, the upper opening edge of the tongue groove 36 at the joint plane F is bevelled at 47, which also facilitates the insertion of the tongue into the tongue groove.

Figure 1B:
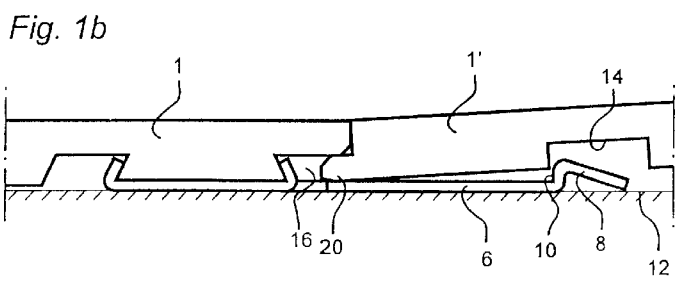
Figure 1C:
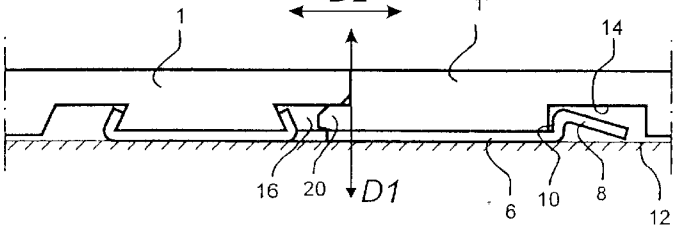
Figure 3A:
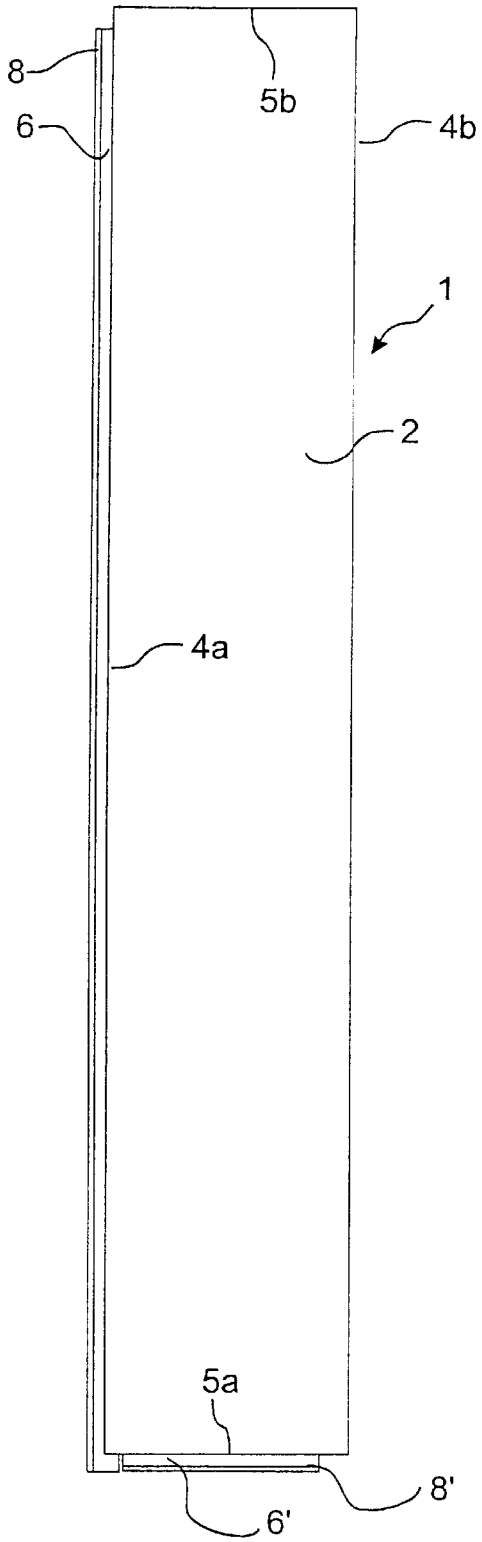
FIGS. 3*a–b* are a top plan view and a bottom view respectively of a floorboard according to WO 94/26999.
Figure 3B:
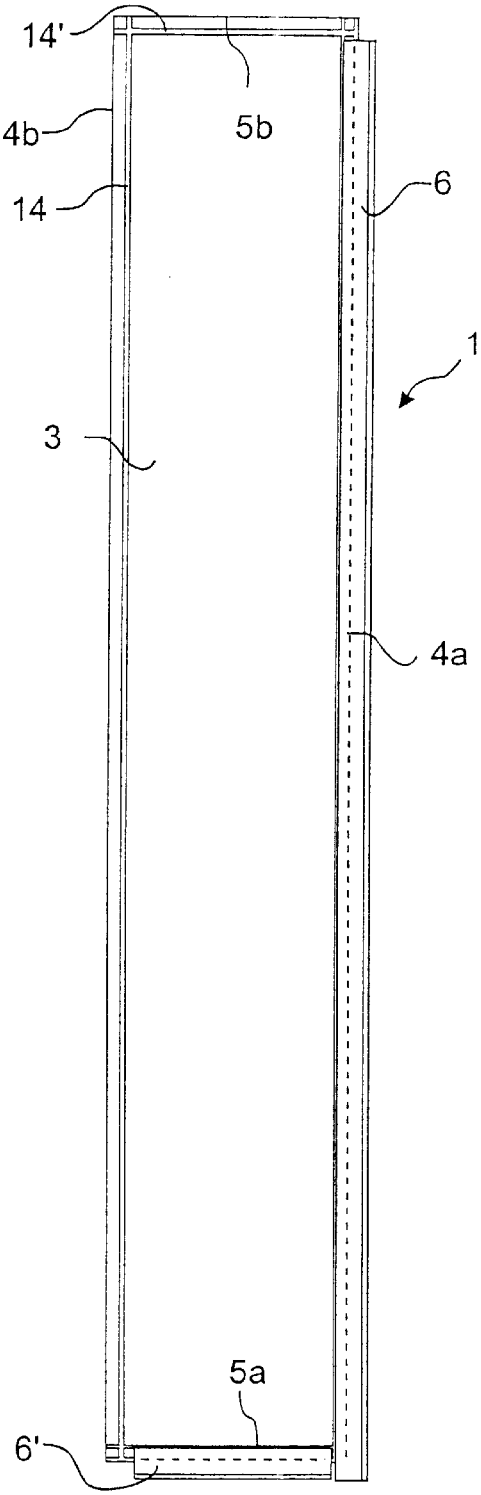
Figure 4A:
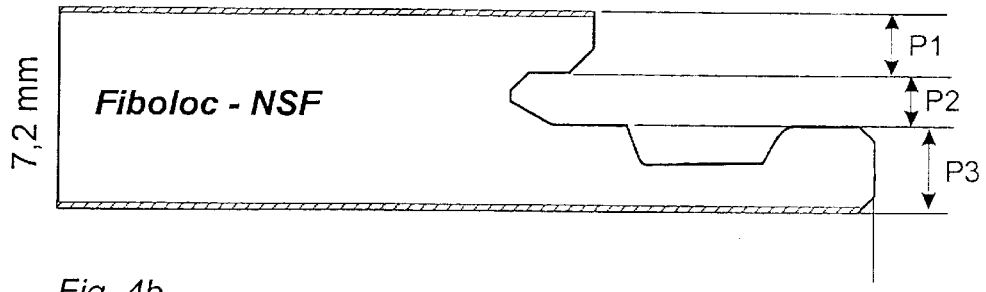
FIG. 4 shows three strip-lock systems available on the market with an integrated strip of fibreboard and a balancing layer, and a strip lock system according to U.S. Pat. No. 4,426,820.
Figure 4B:
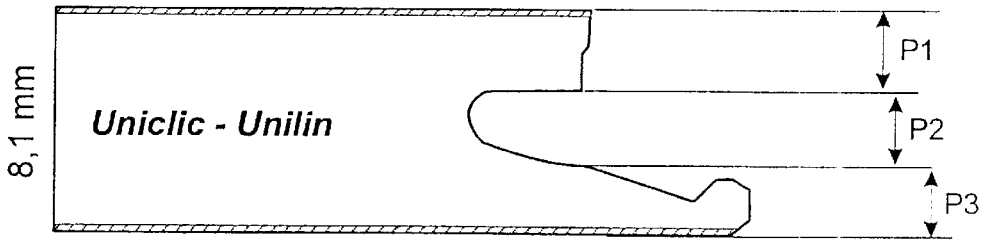
Figure 4C:
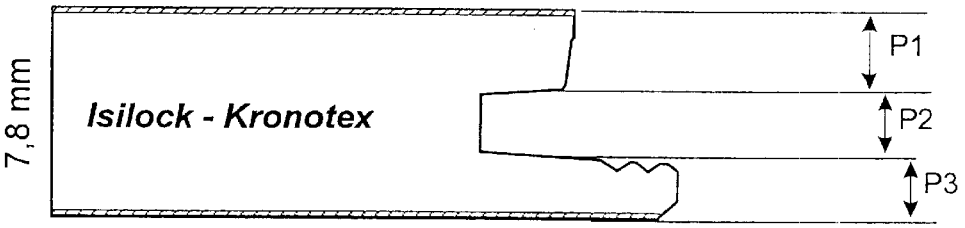
Figure 4D:
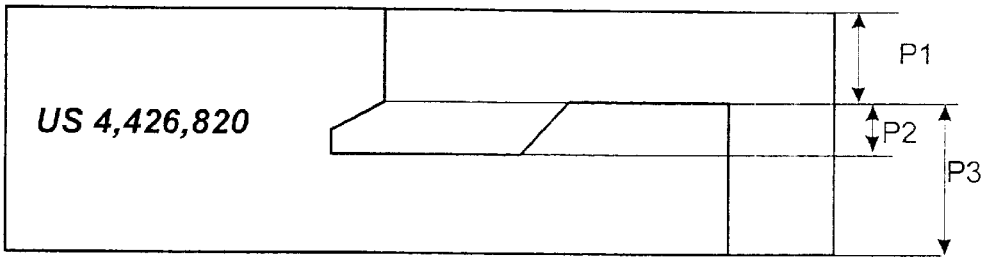

As mentioned, the height of the locking element 8 has been retained essentially unchanged compared with prior art according to WO 99/661151 and "Fiboloc®". This results in the locking effect being retained. The locking angle A of the two cooperating operative locking surfaces 10, 10' is <90° and preferably in the range 55–85°. Most preferably, the locking surfaces 10, 10' extend approximately tangentially to a circular arc which has its centre where the joint plane F passes through the upper side of the floorboard. If the guiding portion 9 of the locking element immediately above the locking surface 10 has been slightly rounded, the guiding of the locking element 8 into the locking groove 14 is facilitated in the downward angling of the floorboard 1' similarly to that shown in FIG. 1*b*. Since the locking together of the two adjoining floorboards 1, 1' in the D2 direction is achieved by the engagement between the operative locking surfaces 10, 10', the locking groove 14 can be somewhat wider than the locking element 8, seen transversely of the joint, so that there can be a gap between the outer end of the locking element and the corresponding surface of the locking groove. As a result, the mounting of the floorboards is facilitated without reducing the locking effect. Moreover, it is preferred to have a gap between the upper side of the locking element 8 and the bottom of the locking groove 14. Therefore the depth of the groove 14 should be at least equal to the height of the locking element 8, but preferably the depth of the groove should be somewhat greater than the height of the locking element.

According to a particularly preferred embodiment of the invention, the tongue 38 and the tongue groove 36 are to be positioned eccentrically in the thickness direction of the floorboards and placed closer to the underside than to the upper side of the floorboards.

The most preferred according to the invention is that the locking system and the floorboards satisfy the relationship $$T-(P1+0.3*P2)>P3,$$

where

T=thickness of the floorboard,

P1=distance between the upper side 2 of the floorboard and said upper contact surface 43, measured in the thickness direction of the floorboard, P2=distance between said upper and lower contact surfaces 43, 45, measured in the thickness direction of the floorboard, and P3=distance between the upper edge 49 of the locking element 8 closest to the upper side of the floorboard and the underside 3 of the floorboard.

It has been found advantageous from the viewpoint of strength and function if the locking system also satisfies the relationship P2>P3.

Moreover, it has been found particularly advantageous if the relationship P3>0.3 * T is satisfied since this results in more reliable connection of adjoining floorboards.

If the relationship P1>0.3 * T is satisfied, the best material thickness is obtained in the material portion between the tongue groove 36 and the upper side 2 of the floorboard. This reduces the risk of this material portion warping so that the superposed surface coating will no longer be in the same plane as the surface coating of an adjoining floorboard.

To ensure great strength of the tongue 38 it is preferred for the dimensions of the tongue to satisfy the relationship P2>0.3 * T.

By forming the cooperating portions of the tongue 38 and the tongue groove 36 in such manner that the inner boundary surfaces of the tongue groove in the first floorboard 1 are positioned further away from the vertical joint plane F than the corresponding surfaces of the tongue 38 of the second floorboard 1' when the first and the second floorboards are mechanically assembled, the insertion of the tongue into the tongue groove is facilitated. At the same time the requirements for exact guiding of the chip-removing tools in the plane of the floorboards are reduced.

Moreover it is preferred for the locking groove 14, seen perpendicular to the joint plane F, to extend further away from the vertical joint plane F than do corresponding portions of the locking element 8, when the first and the second floorboards 1, 1' are mechanically assembled. This design also facilitates laying and taking up of the floorboards.

In a floor which is laid using boards with a locking system according to the present invention, the first and the second floorboards are identically designed. Moreover it is preferred for the floorboards to be mechanically joinable with adjoining floorboards along all four sides by means of a locking system according to the present invention.

Figure 7:
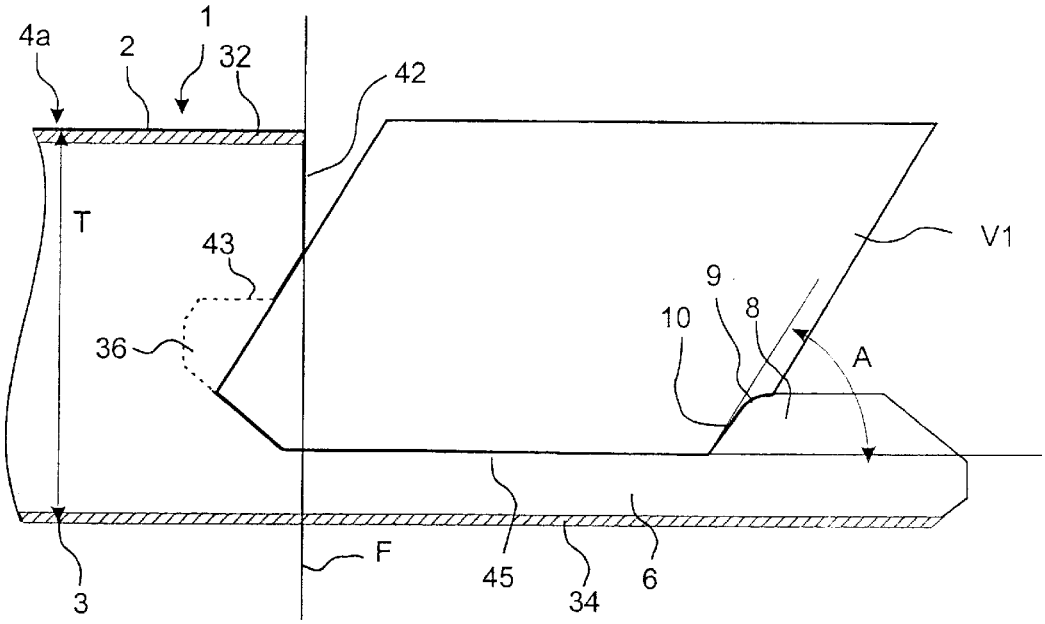
FIGS. 7+8 illustrate an example of a manufacturing method according to the invention for manufacturing a floorboard with a locking system according to the invention.
Figure 8:
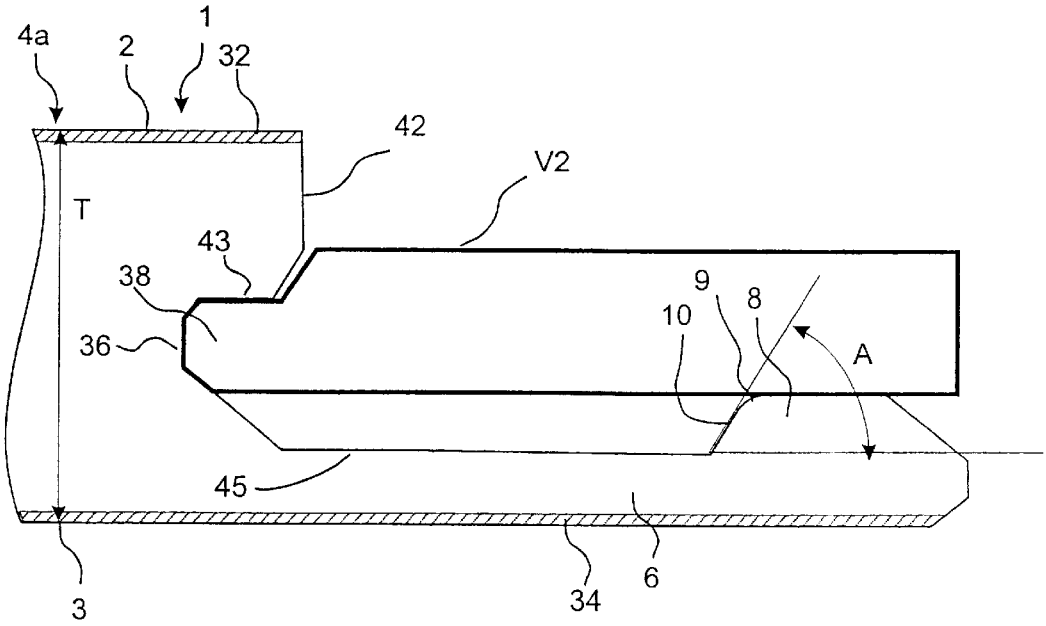

FIGS. 7 and 8 describe the manufacturing technique according to the present invention. Like in prior-art technique, chip-removing working is used, in which chip-removing milling or grinding tools are brought into chip-removing contact with parts of said first and second joint edges 4*a*, 4*b* of the floorboard on the one hand to form the upper surface portions 41, 42 of the joint edges 4*a*, 4*b* so that these are positioned exactly at the correct distance from each other, measured in the width direction of the floorboard, and on the other hand to form the locking groove 14, the strip 6, the locking element 8, the tongue 38, the tongue groove 36 and the upper and lower contact surfaces 43 and 45 respectively.

Like in prior-art technique, the floorboard material is first worked to obtain the correct width and the correct length between the upper surface portions 41, 42 of the joint edges 4*a*, 4*b* (5*a*, 5*b* respectively).

According to the invention, the subsequent chip-removing working then takes place, in contrast to prior-art technique, by chip-removing working in two stages with tools which must be guided with high precision in one direction only (in addition to the displacement direction along the floorboard material).

Manufacturing by means of angled tools is a method known per se, but manufacturing of plane-parallel contact surfaces between tongue and tongue groove in combination with a locking element, whose upper side is positioned in a plane above the lower contact surface of the locking system, is not previously known.

In contrast to prior-art technique the tongue groove 36 is thus made in two distinct stages by using two tools V1, V2. The first chip-removing tool V1 is used to form parts of the tongue groove 38 closest to the underside 3 of the floorboard and at least part of the lower contact surface 45. This tool V1 has chip-removing surface portions which are directed obliquely inwards and past the joint plane F. An embodiment of the chip-removing surface portions of this first tool is shown in FIG. 7. In this case, the tool forms the entire lower contact surface 45, the lower parts of the tongue groove 36 which is to be made, and the operative locking surface portion 10 and guiding surface 9 of the locking element 8. As a result, it will be easier to maintain the necessary tolerances since this tool need be positioned with high precision merely as regards cutting depth (determines the position of the lower contact surface 45 in the thickness direction of the floorboard) and in relation to the intended joint plane F. In this embodiment, this tool therefore forms portions of the tongue groove 36 up to the level of the upper side of the locking element 8. The location of the tool in the vertical direction relative to the floorboard is easy to maintain, and if the location perpendicular to the joint plane F is exactly guided, the operative surface portion 10 of the locking element will be placed exactly at the correct distance from the edge between the joint plane F and the upper side 3 of the floorboard.

The first tool V1 thus forms parts of the tongue groove 36 that is to be made, the strip 6, the lower contact surface 45, the operative locking surface 10 and the guiding part 9 of the locking element 8. Preferably this tool is angled at an angle A to the principal plane of the floorboard, which corresponds to the angle of the locking surface.

It is obvious that this working in the first manufacturing step can take place in several partial steps, where one of the partial steps is the forming of merely the lower parts of the tongue groove and of the lower contact surface 45 outside the joint plane 5 by means of an angled milling tool. The rest of the strip and the locking element can in a subsequent partial step be formed by means of another tool, which can also be angled and inclined correspondingly. The second tool, however, can also be straight and be moved perpendicular downwards in relation to the upper side of the floorboard. Therefore the tool V1 can be divided into two or more partial tools, where the partial tool closest to the joint plane F forms parts of the tongue groove and the entire lower contact surface 45, or parts thereof, while the subsequent partial tool or tools form the rest of the strip 6 and its locking element 8.

In a second manufacturing step, the rest of the tongue groove 38 and the entire contact surface 43 are formed by means of a chip-removing tool V2, whose chip-removing surface portions (shown in FIG. 8) are moved into chip-removing engagement with the first joint portion 4*a* in a plane which is essentially parallel with a plane containing the upper side 2 of the floorboard. The insertion of this tool V2 thus takes place parallel with the upper side 3 of the floorboard, and the working takes place in levels between the upper side of the locking element 8 and the upper side of the floorboard.

The preferred manufacturing method is most suitable for rotating milling tools, but the joint system can be manufactured in many other ways using a plurality of tools which each operate at different angles and in different planes.

By the forming of the tongue groove being divided into two steps and being carried out using two tools, V1 and V2, it has become possible to position the lower contact surface 45 at a level below the upper side of the locking element. Moreover, this manufacturing method makes it possible to position the tongue and the tongue groove eccentrically in the floorboard and form the tongue and the tongue groove with a greater thickness in the thickness direction of the floorboard than has been possible up to now in the manufacture of floorboards, in which the strip is integrated with and preferably monolithic with the rest of the floorboard. The invention can be used for floorboards where the main portion of the board and the joint edge portions of the board are of the same composition, as well as for floorboards where the joint edge portions are made of another material but are integrated with the board before the chip-removing w working to form the different parts of the locking system.

A plurality of variants of the invention are feasible. The joint system can be made with a number of different joint geometries, where some or all of the above parameters are different, especially when the purpose is to prioritise a certain property over the other properties.

The owner has contemplated and tested a number of variants based on that stated above.

The height of the locking element and the angle of the surfaces can be varied. Nor is it necessary for the locking surface of the locking groove and the locking surface of the locking element to have the same inclination. The thickness of the strip may vary over its width perpendicular to the joint plane F, and in particular the strip can be thinner in the vicinity of the locking element. Also the thickness of the board between the joint plane F and the locking groove 14 may vary. The vertical and horizontal joint can be made with a play between all surfaces which are not operative in the locking system, so that the friction in connection with displacement parallel with the joint edge is reduced and so that mounting is thus facilitated. The depth of the tongue groove can be made very small, and also with a tongue groove depth of less than 1 mm, sufficient strength can be achieved with a rigid thick tongue.

FIGS. 9*a–d* show some examples of other embodiments of the invention. Those parts of the tongue groove and the strip which are positioned below the marked horizontal plane H, are preferably made by means of an angled tool (corresponding to the tool V1), while those parts of the tongue groove which are positioned above this horizontal plane are made by means of a horizontally operating tool (corresponding to the tool V2).

Figure 9A:
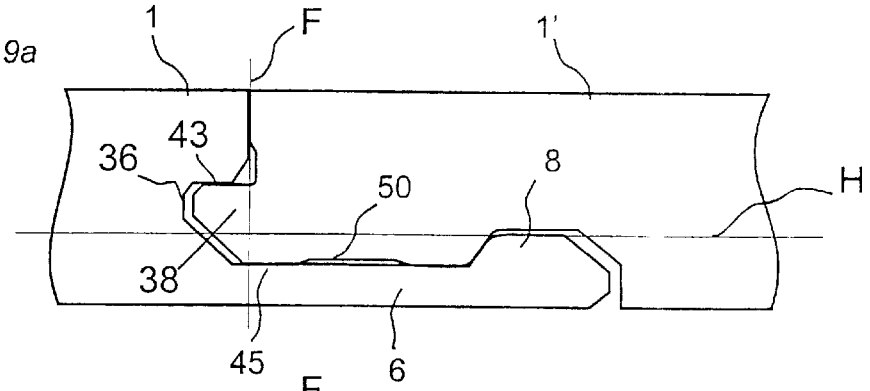
FIGS. 9*a–d* show variants of a floorboard and a locking system according to the present invention.

FIG. 9*a* shows an embodiment where the lower contact surface 45 is essentially outside the joint plane F and a very small part of the contact surface is inside the joint plane F. Between the tongue 38 and the locking groove 14 there is a recess 50 in the underside of the tongue. This recess serves to reduce the friction between the tongue and the strip 6 when displacing the adjoining floorboards 1, 1' along the joint plane F in connection with the laying of the boards.

Figure 9B:
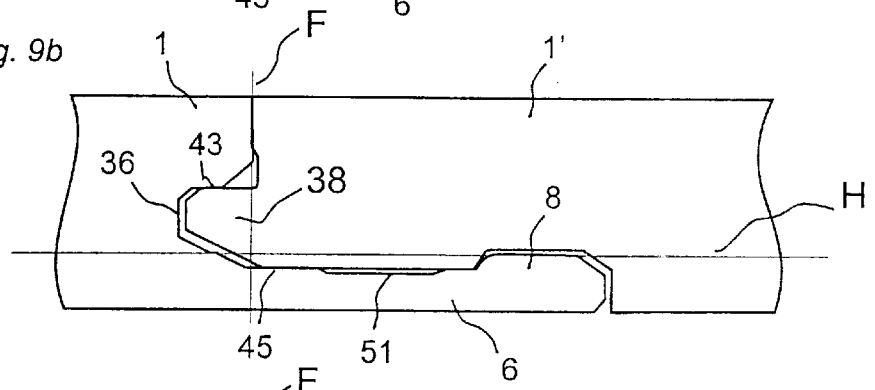

FIG. 9*b* shows an embodiment where the lower contact surface 45 is positioned completely outside the joint plane F. For reducing the friction, a recess 51 has in this case been formed in the upper side of the strip 6, while the contact surface 45 of the locking tongue is kept plane. The locking element 8 has been made somewhat lower, which makes the locking system particularly suitable for joining of short sides by snap action. The recess 51 in the strip 6 also reduces the rigidity of the strip and thus facilitates the joining by snap action.

Figure 9C:
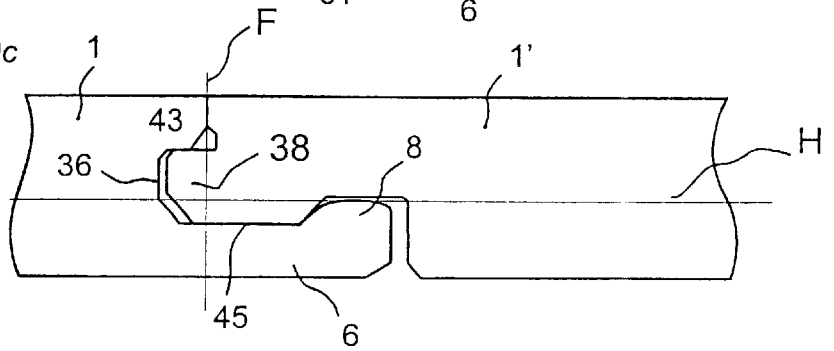

FIG. 9*c* shows an embodiment with a centrically positioned tongue 38 and a short rigid strip 6 where the lower plane contact surface 45 constitutes the upper side of the strip and is largely positioned outside the joint plane F. Just like in the other embodiments according to the invention, the lower contact surface 45 is positioned in a plane below the upper side of the locking element 8, i.e. below the marked horizontal plane H.

Figure 9D:
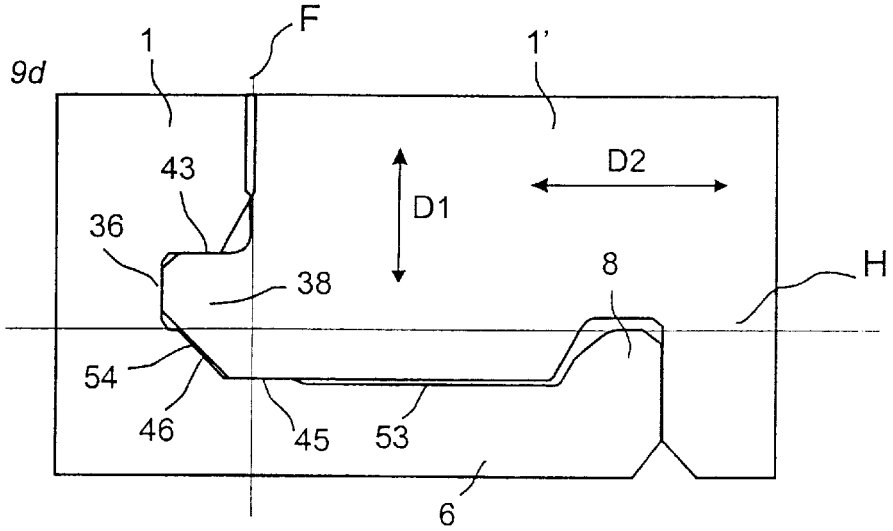

FIG. 9*d* shows an embodiment with a stable locking system. Locking in the vertical direction (D1 direction) takes place by means of upper and lower contact surfaces 43 and 45 respectively, of which the lower extend merely a short distance from the joint plane F. The portions of the strip outside the lower contact surface 45 up to the locking element have been lowered by forming a recess 53 and therefore they do not make contact with the adjoining floorboard 1'. This means a reduction of the friction when displacing adjoining floorboards in the direction of the joint plane F during the laying of the boards. The example according to FIG. 9*d* also shows that the demands placed on the surface portions of the tongue groove 36 furthest away from the joint plane F need not be very high, except that there should be a play 46 between these surface portions and the corresponding surface portions of the tongue 38. The Figure also shows that the working with the tool V2 can be carried out to a greater depth than would result in a straight inclined surface 54 which extends with the same inclination above the horizontal plane H.

What is claimed is:

1. A locking floorboard system for mechanical joining of floorboards, each of the floorboards having a body and an upper side of the body and a balancing layer on a rear side of the body, said system comprising:

a first floorboard;

a second floorboard;

for horizontal joining of a first joint edge of the first floorboard to a second joint edge of the second floorboard at a vertical joint plane, a locking groove which is formed in an underside of said second floorboard and extending parallel with and at a distance from said vertical joint plane at said second joint edge and, a strip integrally formed with the body of said first floorboard, which strip at said first joint edge projects from said vertical joint plane and supports a locking element, which locking element projects towards a plane containing the upper side of said first floorboard and which locking element has a locking surface for coaction with said locking groove, wherein the strip is formed in one piece with the body of the first floorboard and for vertical joining of the first joint edge and the second joint edge, a tongue on the second floorboard which at least partly projects and extends from the vertical joint plane and, a tongue groove in the first floorboard adapted to coact with said tongue, the first and second floorboards having coacting upper and coacting lower contact surfaces, the upper coacting contact surfaces comprise surface portions in said tongue groove and said tongue, the upper and lower contact surfaces are essentially plane-parallel and extend essentially parallel with a plane containing the upper side of the floorboards, and the upper edge of the locking element, which upper edge is closest to a plane containing the upper side of the floorboards, is located in a horizontal plane, which horizontal plane is positioned between the upper and the lower contact surfaces but closer to the lower contact surfaces than to the upper contact surfaces.

2. The system as claimed in claim 1, wherein portions of the floorboard between the lower contact surface and the locking groove have a thickness which is equal to or less than the distance between the lower contact surface and the upper side of the floorboard.

3. The system as claimed in claim 1, wherein the portion of the strip between the lower contact surface and the locking element has a thickness which is equal to or less than the distance between the lower contact surface and the underside of the floorboard.

4. The system as claimed in claim 1, wherein the tongue and the tongue groove are arranged eccentrically in the thickness direction of the floorboards and placed closer to the underside than to the upper side of the floorboards.

5. The system as claimed in claim 1, wherein the locking element has an operative locking surface for coaction with a corresponding operative locking surface of the locking groove, and that said operative locking surfaces are inclined at an angle which is lower than 90°, measured relative to a plane containing the underside of the floorboard.

6. The system as claimed in claim 5, wherein the angle is 55 to 85°.

7. The system as claimed in claim 1, wherein the relationship T−(P1+0.3 * P2)>P3, where T=thickness of the floorboard, P1=distance between the upper side of the floorboard and said upper contact surface, measured in the thickness direction of the floorboard, P2=distance between said upper and lower contact surfaces measured in the thickness direction of the floorboard, and P3=distance between the upper edge of the locking element closest to the upper side of the floorboard and the underside of the floorboard.

8. The system as claimed in claim 7, wherein the relationship P2>P3.

9. The system as claimed in claim 7, wherein the relationship P1>0.3 * T.

10. The system as claimed in claim 7, wherein the relationship P2>0.3 * T.

11. The system as claimed in claim 7, wherein the inner boundary surfaces of the tongue groove in the first floorboard are positioned further away from the vertical joint plane than corresponding surfaces of the tongue of the second floorboard when the first and second floorboards are mechanically assembled.

12. The system as claimed in claim 7, wherein, as seen perpendicular to the joint plane, the locking groove extends further away from the vertical joint plane than the corresponding portions of the locking element when the first and second floorboards are mechanically assembled.

13. The system as claimed in claim 7, wherein the first and second floorboards are identically designed.

14. A floor consisting of floorboards which are mechanically joined by means of the locking system as claimed in claim 13.

15. A floorboard provided with a locking system as claimed in claims 7.

16. A floorboard as claimed in claim 15, which is mechanically joinable with adjoining boards along all its four sides by means of a locking system.

17. The system as claimed in claim 1, wherein each of the floorboards includes a surface layer on an upper side of the body.

18. A method for making floorboards with a locking system for mechanical joining of two adjoining floorboards, which have a body and an upper side of the body and a balancing layer on the rear side of the body, in which method the floorboards, by chip-removing working, are formed with a locking system, which for horizontal joining of a first and a second joint edge of a first and a second floorboard at a vertical joint plane, comprises a locking groove formed in the underside of said second board and extending parallel with and at a distance from said vertical joint plane at said second joint edge and, a strip formed integrally with the body of said first board and at said first joint edge projecting from said vertical joint plane and supporting a locking element, which projects towards a plane containing the upper side of said first floorboard and having a locking surface for coaction with said locking groove, and for vertical joining of the first and second joint edge of the first and second floorboards, comprises a tongue which projects from said second joint edge and the upper part of which extends from said vertical joint plane and, a tongue groove intended for coaction with said tongue, said first and second floorboards having cooperating upper and cooperating lower contact surfaces which are essentially plane-parallel and extend essentially parallel with a plane containing the upper side of said floorboards, of which at least the upper contact surfaces comprise surface portions in said tongue groove and said tongue, in which method the chip-removing working is carried out by chip-removing milling or grinding tools being brought into chip-removing contact with parts of said first and second joint edges of the floorboard for forming said locking groove, said strip, said locking element, said tongue, said tongue groove and said upper and lower contact surfaces, wherein parts of said tongue groove and at least parts of the lower contact surface are formed by means of a chip-removing tool, whose chip-removing surface portions are brought into removing contact with the first joint portion and are directed obliquely inwards and past said joint plane and the upper contact surface and parts of the tongue groove are formed by means of a chip-removing tool, whose chip-removing surface portions are brought into removing engagement with the first joint portion in a plane which is essentially parallel with a plane containing the upper side of the floorboard.

19. The method as claimed in claim 18, wherein the chip-removing working is carried out in such manner that portions of the floorboard between the lower contact surface and the locking groove obtains a thickness which is equal to or less than the distance between the lower contact surface and the upper side of the floorboard.

20. The method as claimed in claim 19, wherein the chip-removing working is carried out in such manner that the upper edge of the locking element, which upper edge is closest to a plane containing the upper side of the floorboard, is positioned between the lower and upper contact surfaces but closer to the lower than to the upper contact surfaces.

21. The method as claimed in claim 20, wherein the chip-removing working is carried out in such manner that the relationship $$T-(P1+0.3*P2)>P3,$$

is achieved, where

T=thickness of the floorboard,

P1=distance between the upper side of the floorboard and said upper contact surface, measured in the thickness direction of the floorboard, P2=distance between said upper and lower contact surfaces measured in the thickness direction of the floorboard, and P3=distance between the upper edge of the locking element closest to the upper side of the floorboard and the underside of the floorboard.

22. The method as claimed in claim 21, wherein the chip-removing working is carried out in such a manner that the relationship P2>P3 is achieved.

23. The method as claimed in claim 21, wherein the chip-removing working is carried out in such manner that the relationship P3>0.3 * T is achieved.

24. The method as claimed in claim 21, wherein the chip-removing working is carried out in such manner that the relationship P1>0.3 * T is achieved.

25. The method as claimed in claim 21, wherein the chip-removing working is carried out in such manner that the relationship P2>0.3 * T is achieved.

26. The method as claimed in claim 25, wherein the chip-removing working is carried out in such manner that the inner boundary surfaces of the tongue groove in the first floorboard are located further away from the vertical joint plane than the corresponding outer boundary surfaces of the tongue of the second floorboard when the first and second floorboards are mechanically assembled.

27. The method as claimed in claim 25, wherein this chip-removing working is carried out in such manner that the locking groove, seen perpendicular to the joint plane, extends further away from the vertical joint plane than corresponding portions of the locking element when the first and second floorboards are mechanically assembled.

28. The method as claimed in claim 25, wherein the chip-removing working is carried out in such-manner that the bottom of the locking groove is positioned closer to the upper side of the floorboard than is the upper side of the locking element.

29. The method as claimed in claim 25, wherein the chip-receiving working is carried out in such manner that the locking element obtains an operative locking surface for coaction with a corresponding operative locking surface of the locking groove, and that these operative locking surfaces will be inclined at such an angle relative to a plane containing the underside of the floorboard that the locking surfaces extend essentially tangentially relative to a circular arc with its centre where the vertical joint plane intersects the upper side of the floorboard, seen in a vertical section perpendicular to said joint plane.

30. The method as claimed in claim 18, wherein the chip-removing working is carried out in such manner that the tongue and the tongue groove are positioned eccentrically in the thickness direction of the floorboard and closer to the underside than to the upper side of the floorboard.

31. The method as claimed in claim 18, wherein each of the floorboards has a surface layer on the upper side of the body.

32. A locking floorboard system for mechanical joining of floorboards, each of the floorboards having a body and an upper side of the body and a balancing layer on a rear side of the body, said system comprising:

a first floorboard;

a second floorboard;

for horizontal joining of a first joint edge of the first floorboard to a second joint edge of the second floorboard at a vertical joint plane, a locking groove which is formed in an underside of said second floorboard and extending parallel with and at a distance from said vertical joint plane at said second joint edge and, a strip integrally formed with the body of said first floorboard, which strip at said first joint edge projects from said vertical joint plane and supports a locking element, which locking element projects towards a plane containing the upper side of said first floorboard and which locking element has a locking surface for coaction with said locking groove, and for vertical joining of the first joint edge and the second joint edge, a tongue on the second floorboard which at least partly projects and extends from the vertical joint plane and, a tongue groove in the first floorboard adapted to coact with said tongue, the first and second floorboards having coacting upper and coacting lower contact surfaces, the upper coacting contact surfaces comprise surface portions in said tongue groove and said tongue, the upper and lower contact surfaces are essentially plane-parallel and extend essentially parallel with a plane containing the upper side of the floorboards, and the upper edge of the locking element, which upper edge is closest to a plane containing the upper side of the floorboards, is located in a horizontal plane, which horizontal plane is positioned between the upper and the lower contact surfaces but closer to the lower contact surfaces than to the upper contact surfaces.

wherein the relationship $T-(P1+0.3 * P2)>P3$, where

T=thickness of the floorboard,

P1=distance between the upper side of the floorboard and said upper contact surface, measured in the thickness direction of the floorboard, P2=distance between said upper and lower contact surfaces measured in the thickness direction of the floorboard, and P3=distance between the upper edge of the locking element closest to the upper side of the floorboard and the underside of the floorboard, wherein the relationship $P3>0.3 * T$.

33. A locking floorboard system for mechanical joining of floorboards, each of the floorboards having a body and an upper side of the body and a balancing layer on a rear side of the body, said system comprising:

a first floorboard;

a second floorboard;

for horizontal joining of a first joint edge of the first floorboard to a second joint edge of the second floorboard at a vertical joint plane, a locking groove which is formed in an underside of said second floorboard and extending parallel with and at a distance from said vertical joint plane at said second joint edge and, a strip integrally formed with the body of said first floorboard, which strip at said first joint edge projects from said vertical joint plane and supports a locking element, which locking element projects towards a plane containing the upper side of said first floorboard and which locking element has a locking surface for coaction with said locking groove, and for vertical joining of the first joint edge and the second joint edge, a tongue on the second floorboard which at least partly projects and extends from the vertical joint plane and, a tongue groove in the first floorboard adapted to coact with said tongue, the first and second floorboards having coacting upper and coacting lower contact surfaces, the upper coacting contact surfaces comprise surface portions in said tongue groove and said tongue, the upper and lower contact surfaces are essentially plane-parallel and extend essentially parallel with a plane containing the upper side of the floorboards, and the upper edge of the locking element, which upper edge is closest to a plane containing the upper side of the floorboards, is located in a horizontal plane, which horizontal plane is positioned between the upper and the lower contact surfaces but closer to the lower contact surfaces than to the upper contact surfaces.

wherein the relationship $T-(P1+0.3 * P2)>P3$, where

T=thickness of the floorboard,

P1=distance between the upper side of the floorboard and said upper contact surface, measured in the thickness direction of the floorboard, P2=distance between said upper and lower contact surfaces measured in the thickness direction of the floorboard, and P3=distance between the upper edge of the locking element closest to the upper side of the floorboard and the underside of the floorboard, wherein there is a gap between the upper side of the locking element and the bottom of the locking groove.

34. A locking floorboard system for mechanical joining of floorboards, each of the floorboards having a body and an upper side of the body and a balancing layer on a rear side of the body, said system comprising:

a first floorboard;

a second floorboard;

for horizontal joining of a first joint edge of the first floorboard to a second joint edge of the second floorboard at a vertical joint plane, a locking groove which is formed in an underside of said second floorboard and extending parallel with and at a distance from said vertical joint plane at said second joint edge and, a strip integrally formed with the body of said first floorboard, which strip at said first joint edge projects from said vertical joint plane and supports a locking element, which locking element projects towards a plane containing the upper side of said first floorboard and which locking element has a locking surface for coaction with said locking groove, and for vertical joining of the first joint edge and the second joint edge, a tongue on the second floorboard which at least partly projects and extends from the vertical joint plane and, a tongue groove in the first floorboard adapted to coact with said tongue, the first and second floorboards having coacting upper and coacting lower contact surfaces, the upper coacting contact surfaces comprise surface portions in said tongue groove and said tongue, the upper and lower contact surfaces are essentially plane-parallel and extend essentially parallel with a plane containing the upper side of the floorboards, and the upper edge of the locking element, which upper edge is closest to a plane containing the upper side of the floorboards, is located in a horizontal plane, which horizontal plane is positioned between the upper and the lower contact surfaces but closer to the lower contact surfaces than to the upper contact surfaces, wherein the relationship $T-(P1+0.3 * P2)>P3$, where T=thickness of the floorboard, P1=distance between the upper side of the floorboard and said upper contact surface, measured in the thickness direction of the floorboard, P2=distance between said upper and lower contact surfaces measured in the thickness direction of the floorboard, and P3 distance between the upper edge of the locking element closest to the upper side of the floorboard and the underside of the floorboard, wherein there is a gap between the side of the locking element furthest away from the joint plane and the edge of the locking groove furthest away from the joint plane.

35. A locking floorboard system for mechanical joining of floorboards, each of the floorboards having a body and an upper side of the body and a balancing layer on a rear side of the body, said system comprising:

a first floorboard;

a second floorboard;

for horizontal joining of a first joint edge of the first floorboard to a second joint edge of the second floorboard at a vertical joint plane, a locking groove which is formed in an underside of said second floorboard and extending parallel with and at a distance from said vertical joint plane at said second joint edge and, a strip integrally formed with the body of said first floorboard, which strip at said first joint edge projects from said vertical joint plane and supports a locking element, which locking element projects towards a plane containing the upper side of said first floorboard and which locking element has a locking surface for coaction with said locking groove, and for vertical joining of the first joint edge and the second joint edge, a tongue on the second floorboard which at least partly projects and extends from the vertical joint plane and, a tongue groove in the first floorboard adapted to coact with said tongue, the first and second floorboards having coacting upper and coacting lower contact surfaces, the upper coacting contact surfaces comprise surface portions in said tongue groove and said tongue, the upper and lower contact surfaces are essentially plane-parallel and extend essentially parallel with a plane containing the upper side of the floorboards, and the upper edge of the locking element, which upper edge is closest to a plane containing the upper side of the floorboards, is located in a horizontal plane, which horizontal plane is positioned between the upper and the lower contact surfaces but closer to the lower contact surfaces than to the upper contact surfaces.

wherein the relationship $T-(P1+0.3 * P2)>P3$, where

T=thickness of the floorboard,

P1=distance between the upper side of the floorboard and said upper contact surface, measured in the thickness direction of the floorboard, P2=distance between said upper and lower contact surfaces measured in the thickness direction of the floorboard, and P3=distance between the upper edge of the locking element closest to the upper side of the floorboard and the underside of the floorboard, wherein the locking element has an operative locking surface for coaction with a corresponding operative locking surface of the locking groove, and that these operative locking surfaces are inclined at such an angle relative to a plane containing the underside of the floorboard that the locking surfaces extend essentially tangentially relative to a circular arc with it centre where the vertical joint plane intersects the upper side of the floorboard, seen in a section perpendicular to said joint plane and perpendicular to the floorboards.

36. A locking floorboard system for mechanical joining of floorboards, each of the floorboards having a body and an upper side of the body and a lower side of the body, said system comprising:

a first floorboard;

a second floorboard;

for horizontal joining of a first joint edge of the first floorboard to a second joint edge of the second floorboard at a vertical joint plane, a locking groove which is formed in an underside of said second floorboard and extending parallel with and at a distance from said vertical joint plane at said second joint edge and, a strip formed with the body of said first floorboard, which strip at said first joint edge projects from said vertical joint plane and supports a locking element, which locking element projects towards a plane containing the upper side of said first floorboard and which locking element has a locking surface for coaction with said locking groove, wherein the strip is formed in one piece with the body of the first floorboard and for vertical joining of the first joint edge and the second joint edge, a tongue on the second floorboard which at least partly projects and extends from the vertical joint plane and, a tongue groove in the first floorboard adapted to coact with said tongue, the first and second floorboards having coacting upper and coacting lower contact surfaces, the upper coacting contact surfaces comprise surface portions in said tongue groove and said tongue, the upper and lower contact surfaces are essentially plane-parallel and extend essentially parallel with a plane containing the upper side of the floorboards, and the upper edge of the locking element, which upper edge is closest to a plane containing the upper side of the floorboards, is located in a horizontal plane, which horizontal plane is positioned between the upper and the lower contact surfaces but closer to the lower contact surfaces than to the upper contact surfaces.

37. A method for making floorboards with a locking system for mechanical joining of two adjoining floorboards, which have a body and an upper side of the body and a lower side of the body, in which method the floorboards, by chip-removing working, are formed with a locking system, which for horizontal joining of a first and a second joint edge of a first and a second floorboard at a vertical joint plane, comprises a locking groove formed in the underside of said second board and extending parallel with and at a distance from said vertical joint plane at said second joint edge and, a strip formed with the body of said first board and at said first joint edge projecting from said vertical joint plane and supporting a locking element, which projects towards a plane containing the upper side of said first floorboard and having a locking surface for coaction with said locking groove, and for vertical joining of the first and second joint edge of the first and second floorboards, comprises a tongue which projects from said second joint edge and the upper part of which extends from said vertical joint plane and, a tongue groove intended for coaction with said tongue, said first and second floorboards having cooperating upper and cooperating lower contact surfaces which are essentially plane-parallel and extend essentially parallel with a plane containing the upper side of said floorboards, of which at least the upper contact surfaces comprise surface portions in said tongue groove and said tongue, in which method the chip-removing working is carried out by chip-removing milling or grinding tools being brought into chip-removing contact with parts of said first and second joint edges of the floorboard for forming said locking groove, said strip, said locking element, said tongue, said tongue groove and said upper and lower contact surfaces, wherein parts of said tongue groove and at least parts of the lower contact surface are formed by means of a chip-removing tool, whose chip-removing surface portions are brought into removing contact with the first joint portion and are directed obliquely inwards and past said joint plane and the upper contact surface and parts of the tongue groove are formed by means of a chip-removing tool, whose chip-removing surface portions are brought into removing engagement with the first joint portion in a plane which is essentially parallel with a plane containing the upper side of the floorboard.

* * * * *